US005338144A

United States Patent [19]

Eshleman

[11] Patent Number: 5,338,144

[45] Date of Patent: Aug. 16, 1994

[54] APPARATUS AND METHOD FOR TRANSFERRING BATCHED MATERIALS

[76] Inventor: Roger D. Eshleman, 506 Clayton Ave., Waynesboro, Pa. 17268

[21] Appl. No.: 26,719

[22] Filed: Mar. 5, 1993

[51] Int. Cl.[5] ..... B65G 25/08

[52] U.S. Cl. ..... 414/152; 414/172; 414/421

[58] Field of Search ..... 414/150, 152, 156, 158, 414/172, 179–180, 182, 184, 196, 198, 199, 419, 421, 293, 403

[56] References Cited

U.S. PATENT DOCUMENTS

| | | | |
|---|---|---|---|
| 3,198,354 | 8/1965 | Longenecker | 414/421 X |
| 3,211,304 | 10/1965 | Pottmeyer | 414/180 |
| 3,773,193 | 11/1973 | McClure | 414/184 |
| 4,370,913 | 2/1983 | Gough | 414/419 X |
| 4,513,671 | 4/1985 | Eshleman | 110/101 CF |
| 4,708,571 | 11/1987 | Sappok | 414/419 X |
| 4,730,973 | 3/1988 | Sokolovsky et al. | 414/421 |
| 4,737,064 | 4/1988 | Tanaka | 414/421 |
| 4,759,300 | 7/1988 | Hansen et al. | 110/229 |
| 4,802,424 | 2/1989 | McGinnis et al. | 110/250 |
| 4,924,785 | 5/1990 | Schultz et al. | 110/346 |
| 4,927,313 | 5/1990 | Huggins et al. | 414/421 X |
| 4,930,965 | 5/1990 | Peterson et al. | 414/199 X |
| 4,934,283 | 6/1990 | Kydd | 110/246 |
| 4,984,952 | 1/1991 | Reuter | 414/180 |
| 4,989,842 | 2/1991 | Doriath et al. | 414/184 X |

*Primary Examiner*—Michael S. Huppert
*Assistant Examiner*—James W. Keenan
*Attorney, Agent, or Firm*—Michael R. Swartz; John R. Flanagan

[57] ABSTRACT

A batched materials transferring apparatus includes an elongated drum, a bucket disposed in the drum, and a drive arrangement operable to move the bucket relative to the drum. The drum defines an interior chamber having a longitudinal axis. The drum has a top (or side) opening formed in a first end portion thereof and a bottom opening formed in a second end portion thereof with the top (or side) opening being axially displaced from the bottom opening. The bucket has a side opening formed therein and is slidably movable relative to the drum along the longitudinal axis between the first and second end portions. The drive arrangement is mounted adjacent to the drum and connected to the bucket through one end of the drum. The drive arrangement is operable to move the bucket along an axial path relative to the longitudinal axis of the chamber between the first and second end portions of the drum to respective loading and dumping positions in the interior chamber in which the bucket is respectively aligned with the top (or side) and bottom openings of the drum. The drive arrangement also is operable to move the bucket along a circumferential path relative to the longitudinal axis of the chamber between receiving and discharging orientations such that at the loading position and receiving orientation the bucket communicates through its side opening with the inlet opening of the drum for receiving a batch of materials into the bucket, whereas at the dumping position and discharging orientation the bucket communicates through its side opening with the outlet opening of the drum for discharging the batch of materials from the bucket.

32 Claims, 8 Drawing Sheets

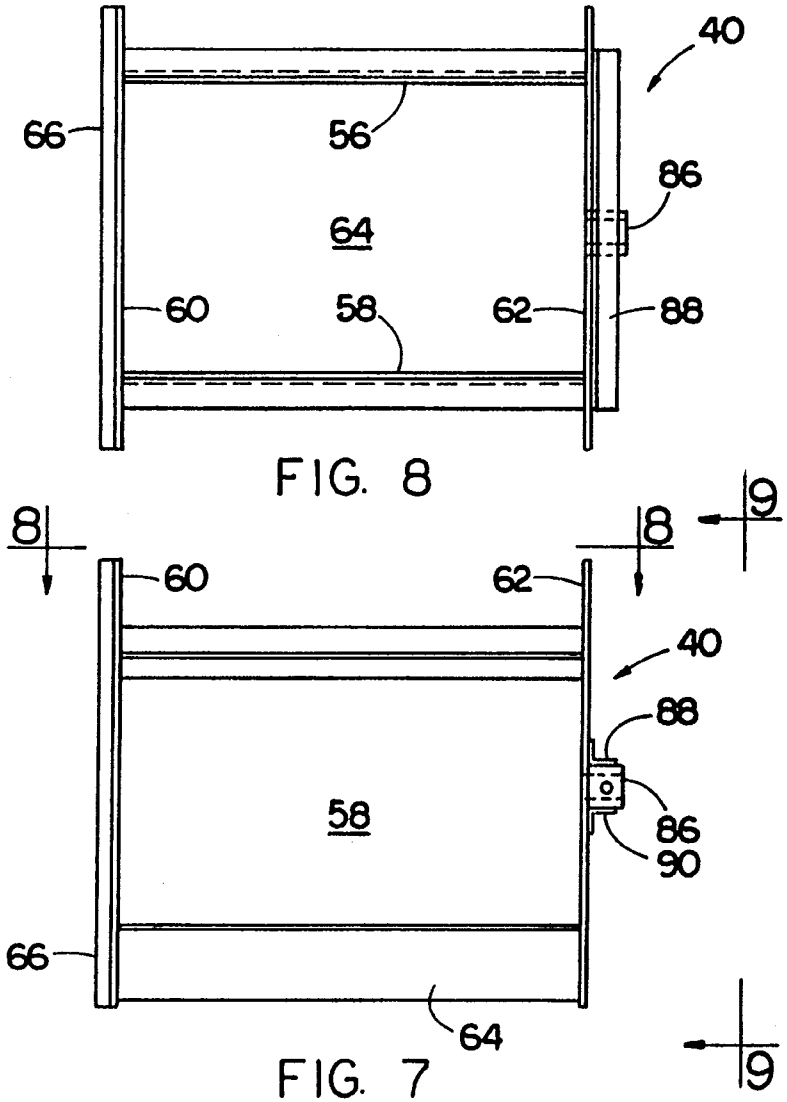
FIG. 8
FIG. 7
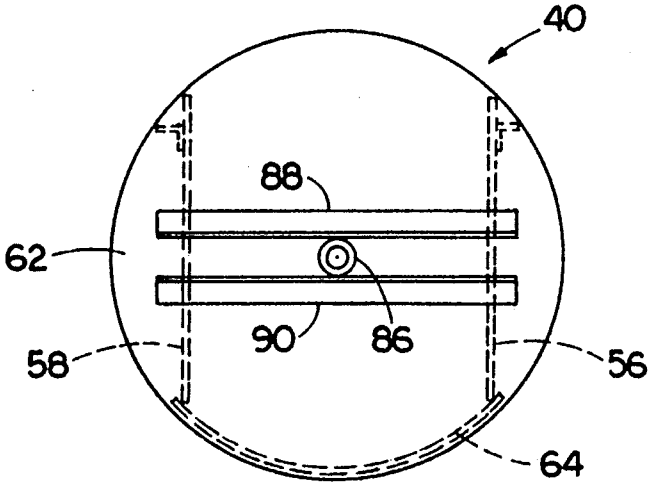
FIG. 9

APPARATUS AND METHOD FOR TRANSFERRING BATCHED MATERIALS

CROSS REFERENCE TO RELATED APPLICATIONS

Reference is hereby made to the following copending U.S. applications dealing with subject matter related to the present invention:

1. "Apparatus And Method For Controlled Processing Of Materials" by Roger D. Eshleman and Paul S. Sievers, assigned U.S. Ser. No. 07/987,928 and filed Dec. 9, 1992.
2. "Multiple Unit Material Processing Apparatus" by Roger D. Eshleman, assigned U.S. Ser. No. 07/987,929 and filed Dec. 9, 1992, now U.S. Pat. No. 5,289,787.
3. "Heat Generator Assembly In A Material Processing Apparatus" by Roger D. Eshleman, assigned U.S. Ser. No. 07/987,936 and filed Dec. 9, 1992.
4. "Casing And Heater Configuration In A Material Processing Apparatus" by Roger D. Eshleman, assigned U.S. Ser. No. 07/987,946 and filed Dec. 9, 1992.

BACKGROUND OF THE INVENTION

1. Field of the Invention

The present invention generally relates to material processing and, more particularly, is concerned with an apparatus and method for transferring batched materials, such as medical and other waste matter, into a material processing apparatus.

2. Description of the Prior Art

The problem of disposal of waste matter involves a material processing challenge that is becoming increasingly acute. The primary material processing methods of waste disposal have been burning in incinerators and burial in landfills. These two material processing methods have severe disadvantages. Burning of waste liberates particulate matter and fumes which contribute to pollution of the air. Burial of wastes contributes to the contamination of ground water. A third material processing method is recycling of waste. Although increasing amounts of waste are being recycled, which alleviates the problems of the two primary material processing methods, presently available recycling methods do not provide a complete solution to the waste disposal problem.

The problem of disposal of biomedical waste materials is even more acute. The term "biomedical waste materials" is used herein in a generic sense to encompass all waste generated by medical hospitals, laboratories and clinics which may contain hazardous, toxic or infectious matter whose disposal is governed by more stringent regulations than those covering other waste. It was reported in *The Wall Street Journal* in 1989 that about 13,000 tons a day of biomedical waste, as much as 20% of it infectious, is generated by around 6,800 U. S. hospitals.

Hospitals and other generators of biomedical waste materials have employed three main material processing methods of waste handling and disposal: (1) on-site incineration with only the residue transferred to landfills; (2) on-site steam autoclaving and followed by later transfer of the waste to landfills; and (3) transfer of the waste by licensed hazardous waste haulers to off-site incinerators and landfills. Of these three main material processing methods, theoretically at least, on-site disposal is the preferred one.

However, many hospital incinerators, being predominantly located in urban areas, emit pollutants at a relatively high rate which adversely affect large populations of people. In the emissions of hospital incinerators, the Environmental Protection Agency (EPA) has identified harmful substances, including metals such as arsenic, cadmium and lead; dioxins and furans; organic compounds like ethylene, acid gases and carbon monoxide; and soot, viruses, and pathogens. Emissions of these incinerators may pose a public health threat as large as that from landfills.

Nonetheless, on-site disposal of biomedical waste materials still remains the most promising solution. One recent on-site waste disposal unit which addresses this problem is disclosed in U.S. Pat. No. 4,934,283 to Kydd. This unit employs a lower pyrolyzing chamber and an upper oxidizing chamber separated by a movable plate. The waste material is deposited in the lower chamber where it is pyrolyzed in the absence of air and gives off a combustible vapor that, in turn, is oxidized in the upper chamber. While this unit represents a step in the right direction, it does not appear to approach an optimum solution to the problem of biomedical waste material disposal.

SUMMARY OF THE INVENTION

The present invention provides a method and apparatus for transferring batched materials, such as medical and other waste matter, for use in conjunction with a material processing apparatus designed to satisfy the aforementioned needs. While the batched materials transferring apparatus of the present invention can be used in different applications, it will be described herein in conjunction with the material processing apparatus disclosed in the cross-referenced copending patent applications which apparatus is particularly useful in waste disposal and particularly effective in disposing biomedical waste material on-site where the waste material is produced.

Accordingly, the present invention is directed to a batched materials transferring apparatus which comprises: (a) an elongated drum defining an elongated interior chamber and having an inlet opening and an outlet opening formed therein and being axially displaced from one another along the drum; (b) a bucket disposed in the drum and being movable relative to the drum; and (c) means connected to the bucket for driving the bucket to undergo movement along a first path relative to the drum between a loading position and a dumping position in the interior chamber thereof in which the bucket is respectively aligned with the inlet opening and the outlet opening of the drum, the driving means also for driving the bucket to undergo movement along a second path relative to the drum and relative to the first path between a receiving orientation and a discharging orientation such that at the loading position and receiving orientation the bucket is adapted to communicate with the inlet opening of the drum for receiving a batch of material into the bucket whereas at the dumping position and discharging orientation the bucket is adapted to communicate with the outlet opening of the drum for discharging the batch of materials from the bucket. The bucket has an opening in a side thereof. The inlet opening in the drum is smaller than the side opening in the bucket, while the side opening in the bucket is smaller than the outlet opening in the drum.

The driving means includes an elongated track aligned along the longitudinal axis of the drum and extending away from an end of the drum, a carriage mounted on the track to undergo reciprocal movement therealong toward and away from the drum along the longitudinal axis thereof, and an elongated shaft having first and second spaced ends. The first end of the shaft is connected to an end of the bucket, while the second end of the shaft is rotatably coupled to the carriage. The driving means further includes a first drive mechanism coupled in a rotary drive relationship to the shaft at a location between its first and second ends thereof, and a second drive mechanism extending between and connected to a support structure and the carriage. The first drive mechanism is selectively operable to rotate the shaft and thereby cause movement of the bucket between the receiving orientation and the discharging orientation. The second drive mechanism is selectively operable to reciprocally move the carriage and the first drive mechanism and elongated shaft therewith along the track and the longitudinal axis toward and away from the drum and thereby cause movement of the bucket between the loading position and the dumping position.

The batched materials transferring apparatus also comprises a cover mounted to undergo movement between closed and opened positions relative to the inlet opening of the drum, and an actuating mechanism disposed adjacent to the drum and connected to the cover. The actuating mechanism is operable to move the cover between the closed and opened positions.

The present invention also is directed to a batched materials transferring method which comprises the steps of: (a) providing an elongated drum having a longitudinal axis and an elongated interior chamber and also having an inlet opening and an outlet opening being axially displaced from one another; (b) moving a bucket in the drum along a first path relative to the drum between a loading position and a dumping position in the interior chamber of the drum in which the bucket is respectively aligned with the inlet opening and the outlet opening of the drum; and (c) moving the bucket along a second path relative to the drum and relative to the first path between a receiving orientation and a discharging orientation such that at the loading position and receiving orientation the bucket is aligned with the inlet opening of the drum for receiving a batch of materials into the bucket whereas at the dumping position and discharging orientation the bucket is aligned with the outlet opening of the drum for discharging the batch of materials from the bucket. The first path along which the bucket is moved is an axial path extending generally along the longitudinal axis. The second path along which the bucket is moved is a circumferential path extending generally around the longitudinal axis. Also, the moving of the bucket in the drum along the first path relative to the drum between the loading position and dumping position and the moving of the bucket along the second path relative to the drum and to the first path between receiving and discharging orientations can occur sequentially or concurrently.

These and other features and advantages and attainments of the present invention will become apparent to those skilled in the art upon a reading of the following detailed description when taken in conjunction with the drawings wherein there is shown and described illustrative embodiments of the invention.

BRIEF DESCRIPTION OF THE DRAWINGS

In the course of the following detailed description, reference will be made to the attached drawings in which:

FIG. 7 is an enlarged side elevational view of the bucket by itself.

FIG. 8 is a top plan view of the bucket as seen along line 8—8 of FIG. 7.

FIG. 9 is an end elevational view of the bucket as seen along line 9—9 of FIG. 7.

DETAILED DESCRIPTION OF THE INVENTION

Figure 1:
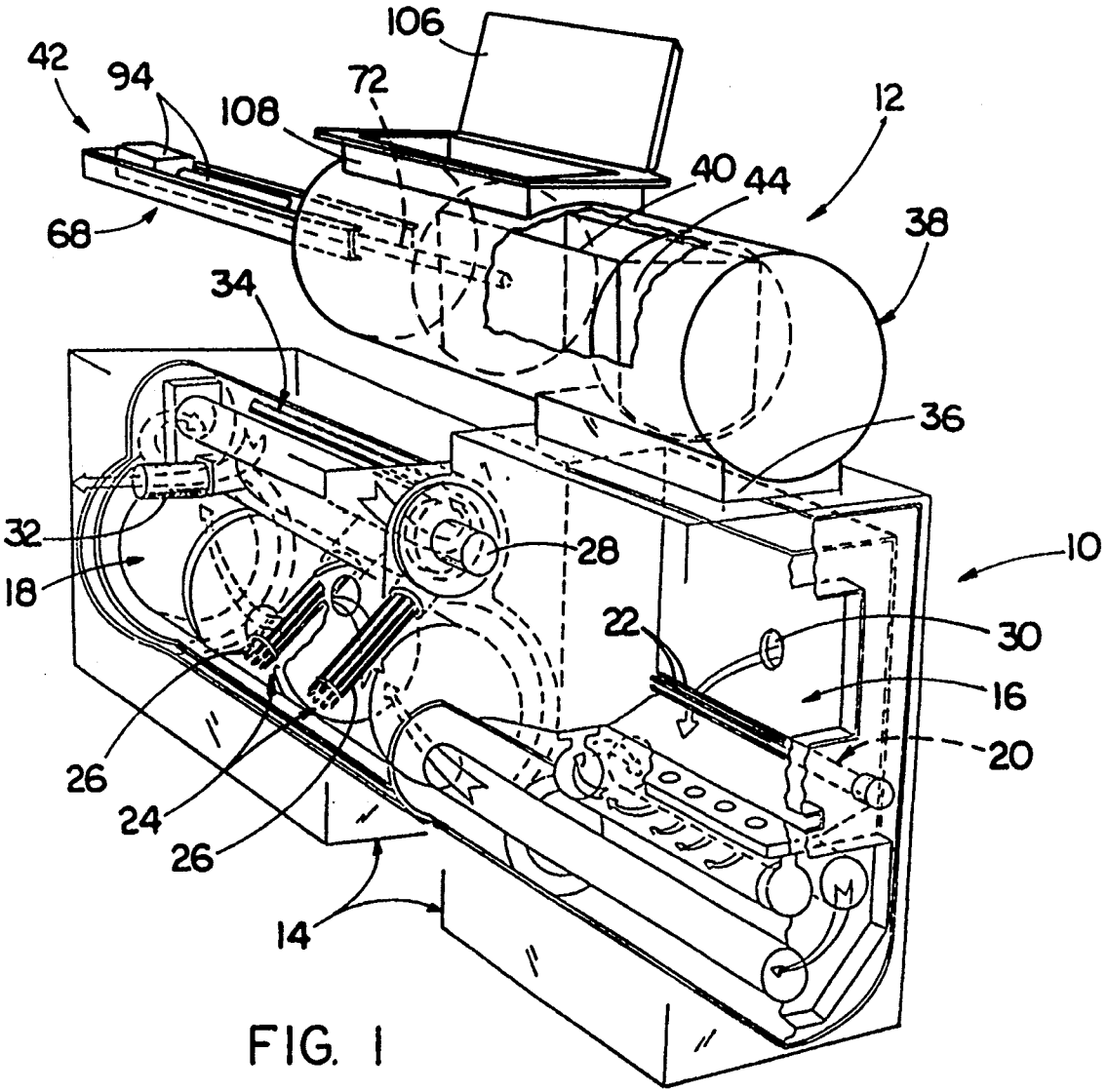
FIG. 1 is a schematical perspective view of a batched materials transferring apparatus of the present invention being shown in conjunction with an apparatus for controlled processing of materials, such as medical and other waste matter.

In the following description, like reference characters designate like or corresponding parts throughout the several views. Also in the following description, it is to be understood that such terms as "forward", "rearward", "left", "right", "upwardly", "downwardly", and the like, are words of convenience and are not to be construed as limiting terms.

Referring now to the drawings, and particularly to FIG. 1, there is illustrated an apparatus, generally designated 10, for controlled processing materials, and in particular for controlled disposal of biomedical waste materials. Also in FIG. 1, there is shown an apparatus, generally designated 12, for transferring batched materials, such as medical and other waste matter, into the material processing apparatus 10. The batched materials transferring apparatus 12 constitutes the subject matter of the present invention. The features of the material processing apparatus 10 comprise the subject matters of the copending patent applications cross-referenced above. A detailed understanding of the material processing apparatus 10 is not necessary to gain a complete and thorough understanding of the batched material transferring apparatus 12, which will be described in detailed hereinafter. Accordingly, only a brief description of the material processing apparatus 10 will be given hereinafter.

Material Processing Apparatus

Referring to FIG. 1, the material processing apparatus 10 basically includes a coolant jacketed vessel 14 defining a first pyrolysis chamber 16 and a second oxidation chamber 18. The material processing apparatus 10 also includes one or more first heater units 20 having a plurality of elongated rod-like electric heating elements 22 mounted in the vessel 14 and being operable to electrically generate heat for pyrolyzing materials in the first pyrolysis chamber 16, and one or more second heater units 24 having a plurality of electric heating elements 26 mounted in the vessel 14 and being operable to electrically generate heat for oxidizing materials in the second oxidation chamber 18.

The material processing apparatus 10 further includes an air flow generating means, preferably an induction fan 28, connected in flow communication with the first and second chambers 16, 18, and first and second airflow safety or inlet valves 30 (only the first valve being shown) connected to the jacketed vessel 14. The material processing apparatus 10 also includes an air intake proportioning valve (not shown) connected in flow communication with the first and second air inlet valves 30. The induction fan 28, proportioning valve, and first and second inlet valves 30 function to produce separate primary and secondary variable flows of air respectively into and through the first and second chambers 16, 18. The respective amounts of air in the primary and secondary flows through the first and second chambers 16, 18 are proportioned by the operation of proportioning valve to separately adjust ratio of the amounts of air flow routed to the first and second air inlet valves 30. The respective amounts of air in the primary and secondary flows are correspondingly varied by varying the speed of operation of the induction fan 28.

Still further at least three temperature sensors (not shown), such as conventional theromocouples, are mounted on the vessel 14 for sensing the temperatures in the first and second chambers 16, 18 and in the coolant circulating about a channel defined by the jacketed vessel 14 about the first and second chambers 16, 18. Additionally, a gas sensor (not shown) is mounted on a discharge outlet 32 of the vessel 14 for sensing the concentration of a predetermined gas, for example oxygen, in the discharge gases. A computer-based central control system (not shown) is incorporated in the material processing apparatus 10 for controlling and directing the overall operation of the apparatus 10. Further, a heat exchanger 34 is connected in flow communication between the second chamber 18 and the discharge outlet 32. The heat exchanger 34 functions to remove heat from and thereby cool the coolant flowing through the channel defined by jacketed vessel 14. The heat removed by the heat exchanger 34 can be employed in other applications in the facility housing the material processing apparatus 10.

During each given cycle of operation of the material processing apparatus 10, the first pyrolysis chamber 16 in which materials will be pyrolyzed receives the materials in batched form through an inlet opening 36 formed in the top of the vessel 14 above the first chamber 16. The batched material, through pyrolysis, or burning in a starved oxygen atmosphere, is converted to a gas that exits the first chamber 16 and passes into the second chamber 18. The second chamber 18 oxidizes the pyrolyzed materials therein and discharges the oxidized materials therefrom through the discharge outlet 32. The exhaust gas is virtually free of any pollution and the original material has been almost completely oxidized so that only a very small amount of fine minute dust or powder particles are collected in a particle separator (not shown).

Batched Materials Transferring Apparatus

Figure 2:
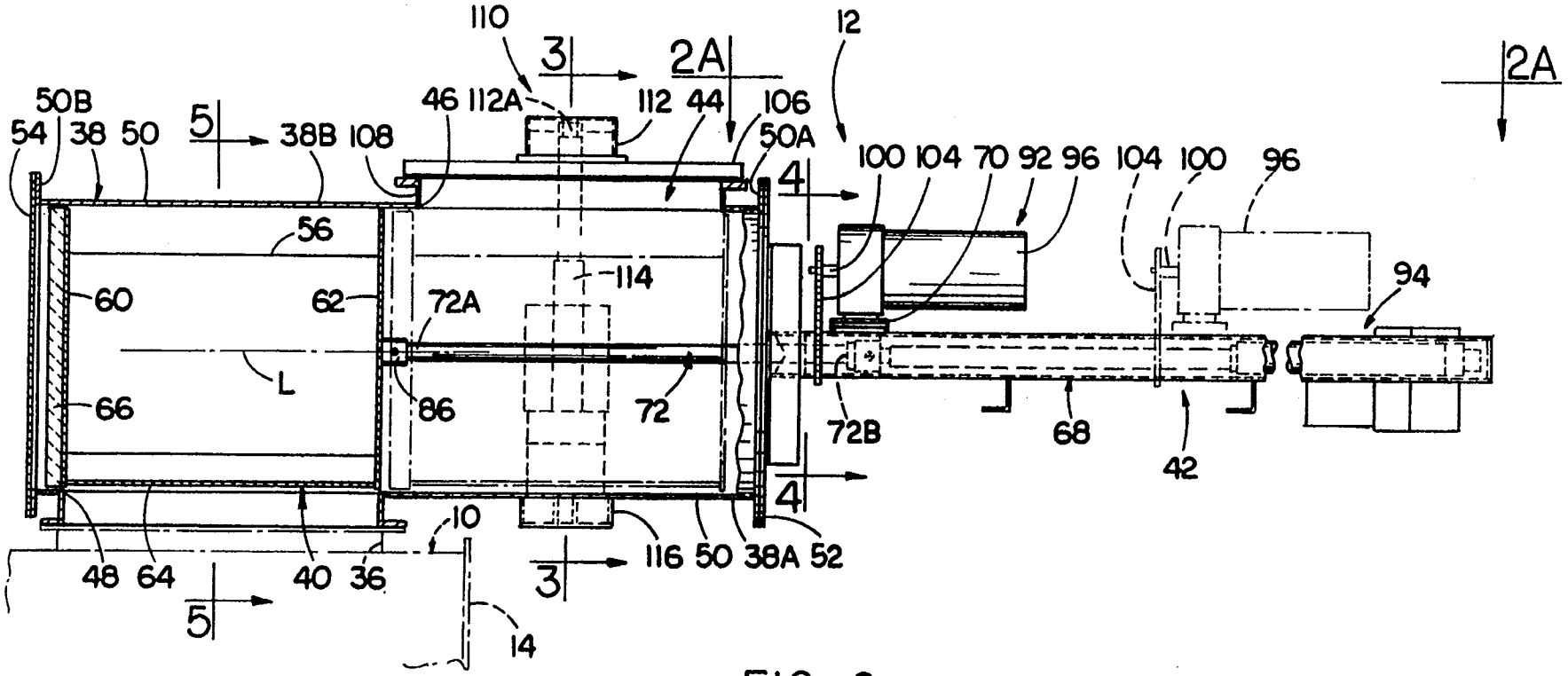
FIG. 2 is an enlarged side elevational view partly in section of the batched materials transferring apparatus of FIG. 1, showing an opposite side from that shown in FIG. 1.
Figure 2A:
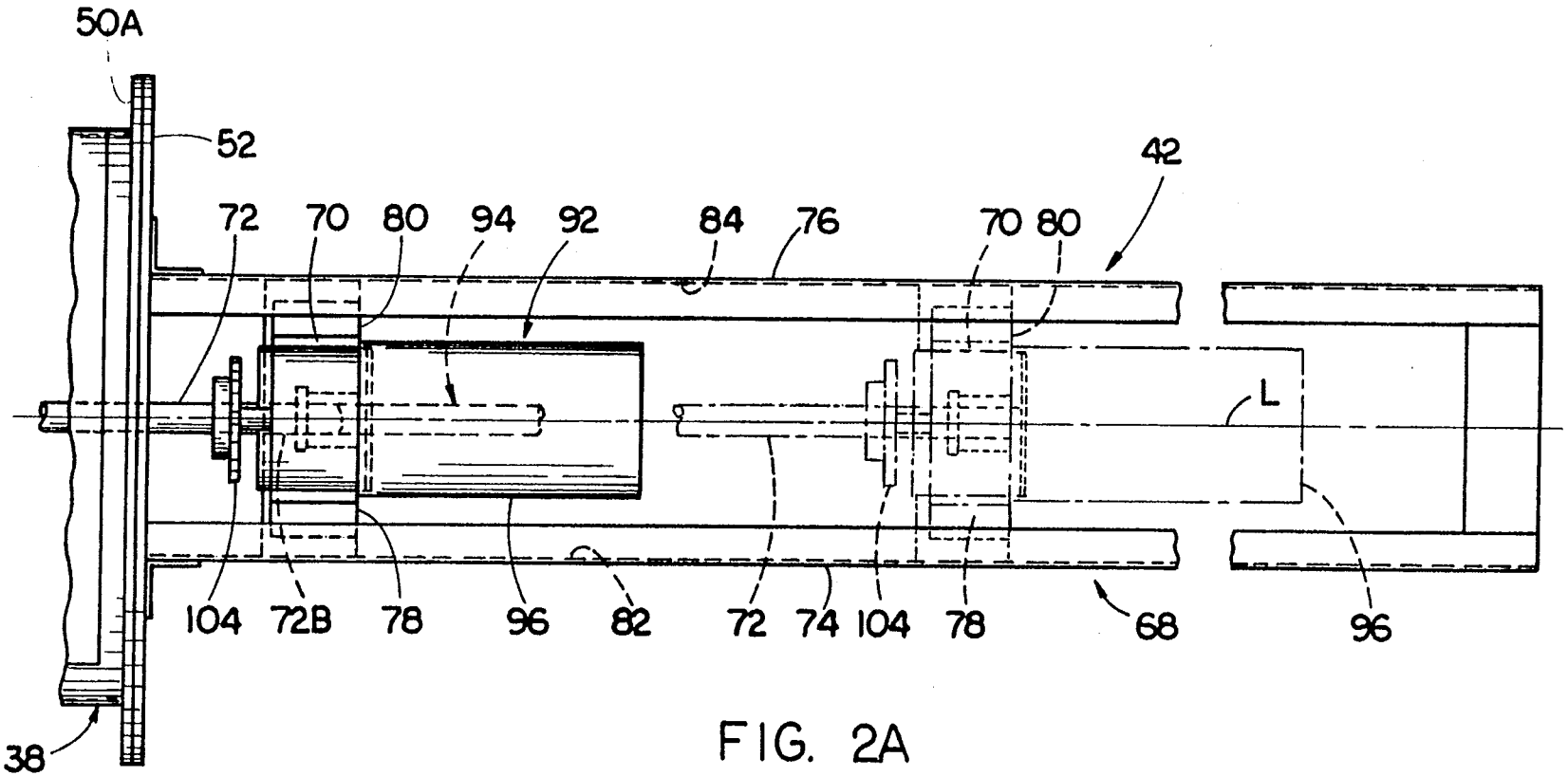
FIG. 2A is an enlarged top plan view of a drive mechanism of the batched materials transferring apparatus as seen along line 2A—2A of FIG. 2.
Figure 4:
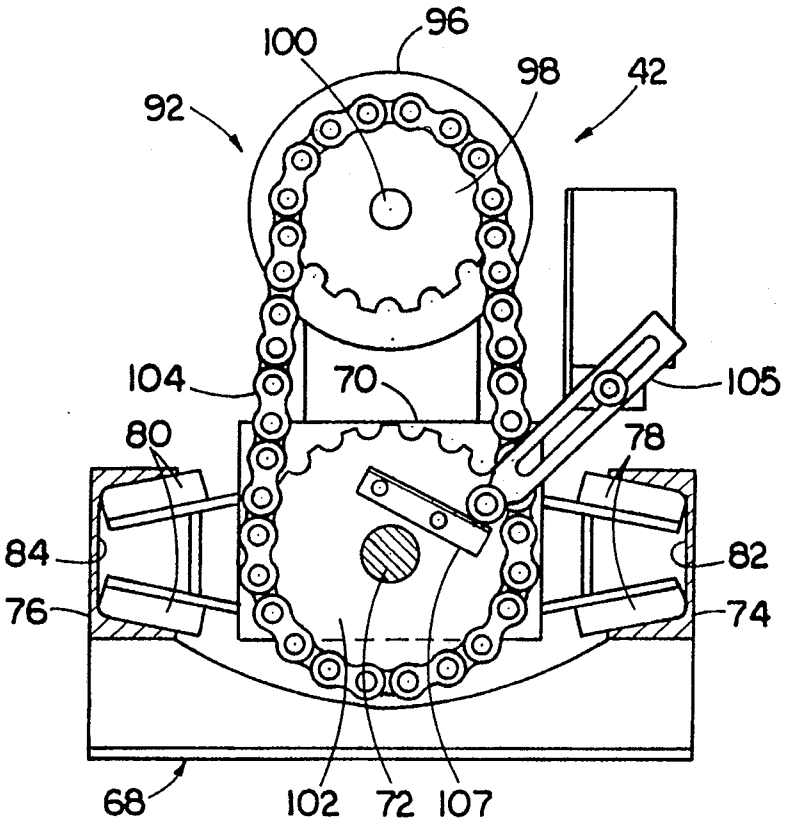
FIG. 4 is an enlarged cross-sectional view of the drive mechanism of the batched materials transferring apparatus taken along line 4—4 of FIG. 2.

Referring to FIGS. 1 and 2, the batched materials transferring apparatus 12 of the present invention is disposed above the material processing apparatus 10 and in flow communication with the inlet opening 36 of the material processing apparatus 10. In its basic components, the batched materials transferring apparatus 12 includes an elongated drum 38, a canister or bucket 40 disposed in and being movable relative to the drum 38, and a drive arrangement 42 operable to move the bucket 40 relative to the drum 38.

Figure 3:
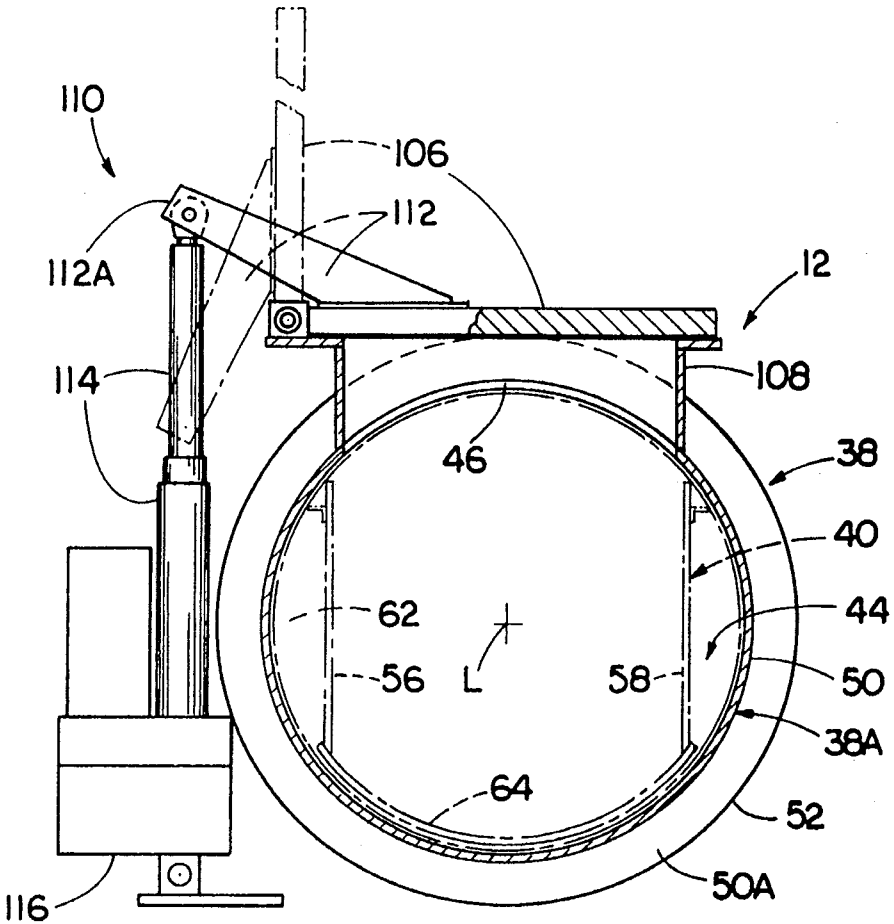
FIG. 3 is an enlarged cross-sectional view of a drum and a cover actuating mechanism of the batched materials transferring apparatus taken along line 3—3 of FIG. 2.
Figure 5:
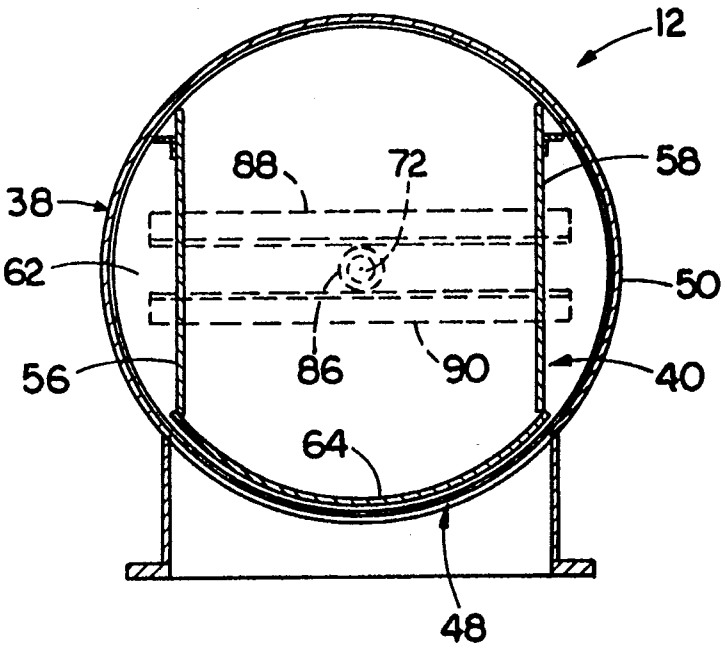
FIG. 5 is an enlarged cross-sectional view of a bucket in the drum of the batched materials transferring apparatus taken along line 5—5 of FIG. 2, the bucket being shown disposed in an upright orientation at a dumping position in the drum.

The elongated drum 38 has an elongated hollow interior chamber 44 with a longitudinal axis L. The drum 38 also has an inlet opening 46 and an outlet opening 48 formed therein being axially displaced from one another with respect the longitudinal axis L of the drum 38. The drive arrangement 42 is connected to the bucket 40 and operable for driving the bucket 40 to undergo movement along a first path relative to the longitudinal axis L of the drum 38 between a loading position (shown in phantom in FIGS. 1 and 3) and a dumping position (FIG. 2) in the hollow interior chamber 44 in which the bucket 40 is respectively aligned with the inlet opening 46 and the outlet opening 48 of the drum 38. The drive arrangement 42 also is operable for driving the bucket 40 to undergo movement along a second path relative to the longitudinal axis L of the drum 38 and relative to the first path between a receiving orientation (FIG. 5) and a discharging orientation (FIG. 6) such that at the loading position and receiving orientation the bucket 40 is adapted to communicate with the inlet opening 46 of the drum 38 for receiving a batch of material into the bucket 40, whereas at the dumping position and discharging orientation the bucket 40 is adapted to communicate with the outlet opening 48 of the drum 38 for discharging the batch of materials from the bucket 40, for example, into the inlet opening 36 of the vessel 14 of the material processing apparatus 10. By way of example, the batched materials can be biomedical waste materials contained within plastic pails with covers (not shown) which will be processed in the material processing apparatus 10 with the biomedical waste materials.

More particularly, referring to FIGS. 2, 3, 5 and 6, the elongated drum 38 of the transferring apparatus 12 preferably is formed by an elongated cylindrical tubular wall 50 and a pair of circular plate-like end walls 52, 54 attached to respective annular flanges 50A, 50B formed about and extending outwardly from the opposite ends of the tubular wall 50. Thus, the interior chamber 44 defined by the tubular wall 50 of the drum 38 also has a substantially cylindrical configuration. As shown in FIGS. 2, 3, 5 and 6, the inlet opening 46 of the drum 38 is formed in the tubular wall 50 at an upstream or first end portion 38A of the drum 38 at substantially the top of the drum. On the other hand, the outlet opening 48, being axially-spaced from the inlet opening 46, is formed in the tubular wall 50 at a downstream or second end portion 38B of the drum 38 at substantially the bottom of the drum.

Figure 10:
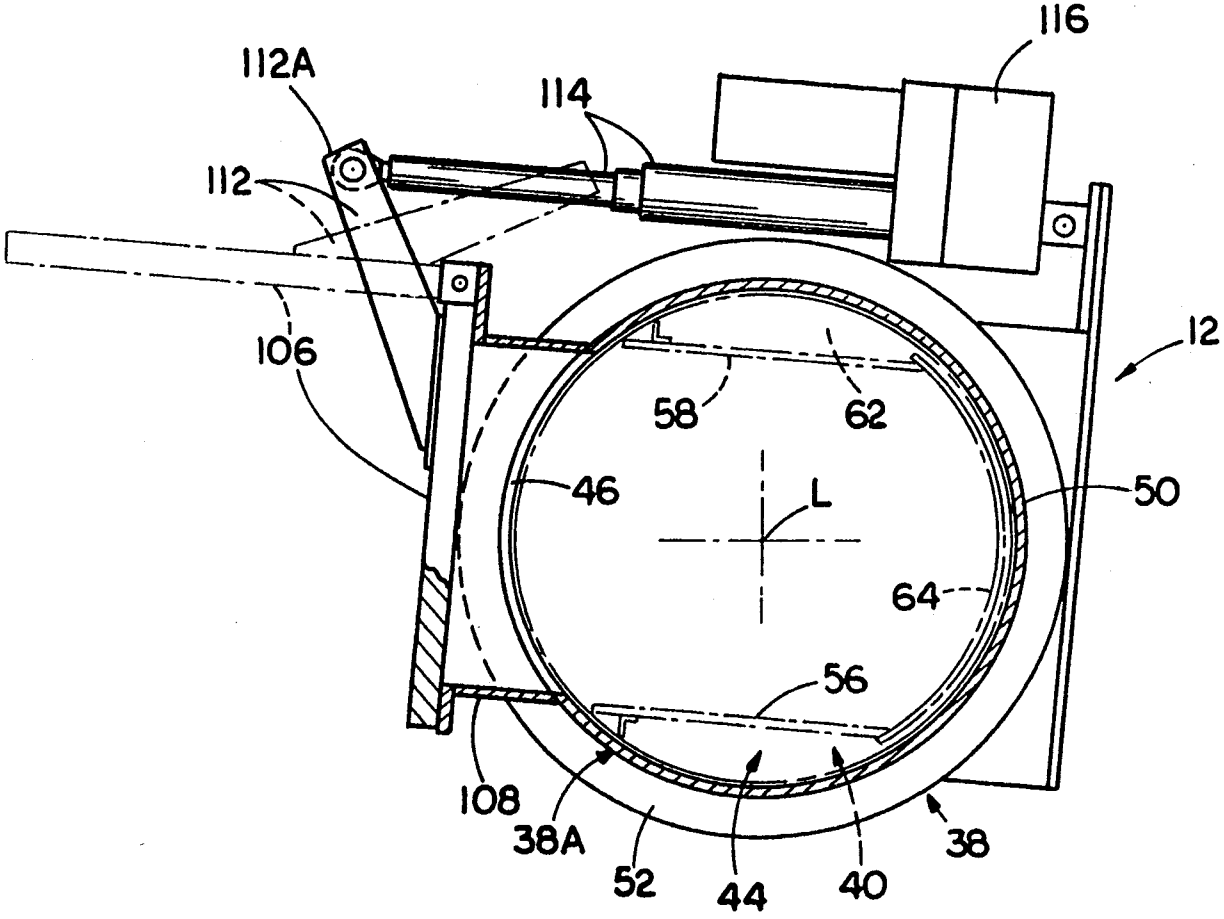
FIG. 10 is a cross-sectional view similar to that FIG. 3 but with the cover actuating mechanism and the bucket in a side loading configuration relative to the drum rather than the top loading configuration of FIG. 3.
Figure 12:
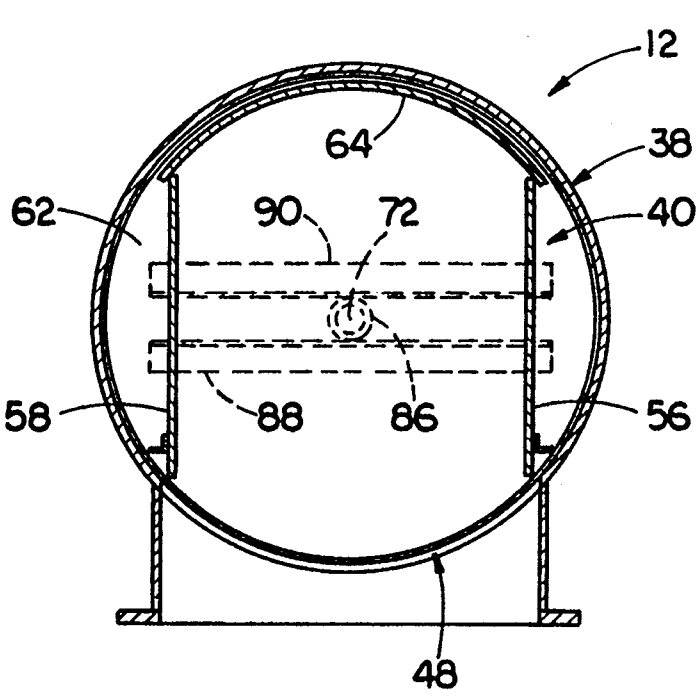
FIG. 12 is a cross-sectional view of the bucket in the drum similar to that of FIG. 6 but with the drum in the side loading configuration of FIG. 10.
Figure 11:
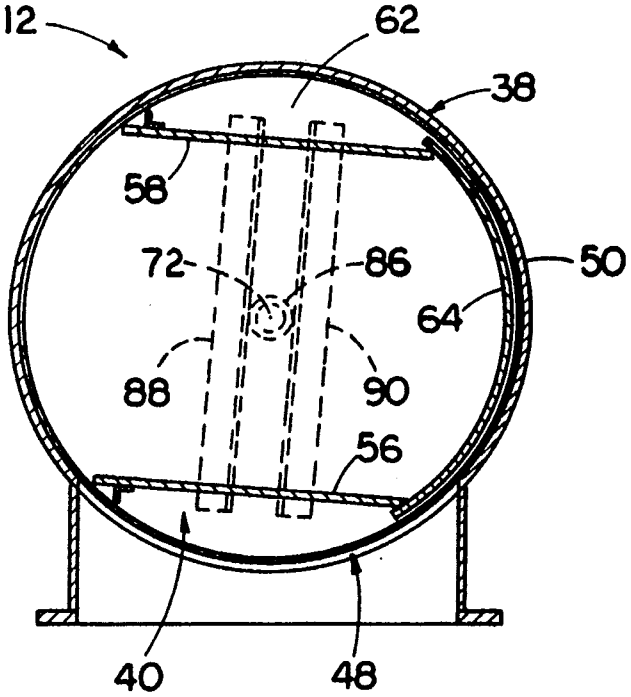
FIG. 11 is a cross-sectional view of the bucket in the drum similar to that of FIG. 5 but with the drum in the side loading configuration of FIG. 10.

The drum 38, as shown in FIGS. 1–3, 5 and 6, is in a top loading configuration wherein the inlet and outlet openings 46, 48 are angularly displaced about 180° apart. Alternatively, as shown in FIGS. 10–12, the drum 38 can be in a side loading configuration wherein the inlet and outlet openings 46, 48 are angularly displaced about 85°–90° apart. In the latter configuration, the inlet opening 46 is thus formed at a side of the drum 38 between the top and bottom thereof.

Figure 6:
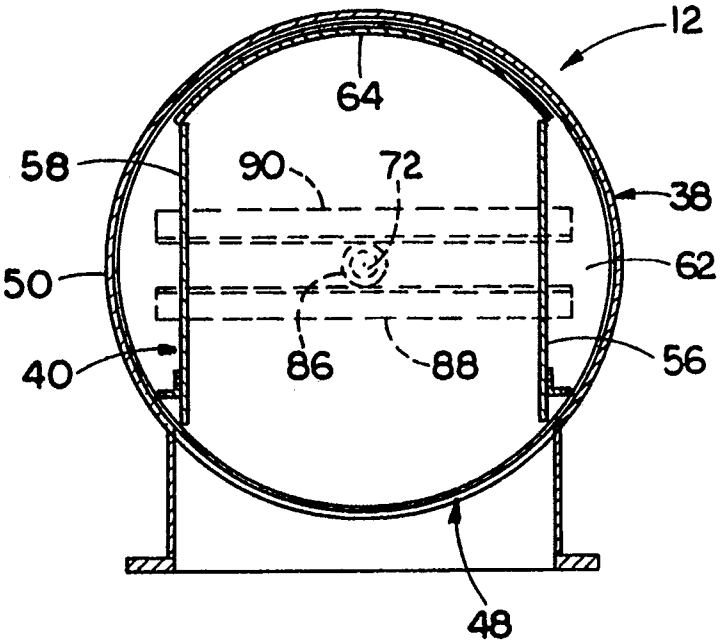
FIG. 6 is a view of the bucket similar to that of FIG. 5 except that the bucket is shown disposed in an inverted orientation at the dumping position in the drum.

Referring to FIGS. 2, 3 and 5–9, the cylindrical bucket 40 of the transferring apparatus 12 is disposed in the cylindrical drum 38 and is reciprocally slidably movable relative to the drum 38 along an axial, linear path relative to the longitudinal axis L between the first and second end portions 38A, 38B. The bucket 40 includes a pair of substantially planar side walls 56, 58 in spaced relation from one another, a pair of substantially circular plate-like outboard and inboard end walls 60, 62 attached respective opposite ends of the spaced side walls 56, 58, and an arcuate-shaped wall 64 attached to and extending between the side walls 56, 58 and end walls 60, 62. The side walls 56, 58 and ends walls 60, 62 together define an open top on the bucket 40, with the bucket 40 in the receiving orientation, as shown in phantom in FIGS. 2 and 3 and in solid form in FIGS. 5 and 9, and an open bottom on the bucket 48 with the bucket 40 in the discharging orientation, as shown in solid form in FIGS. 2 and 5. The arcuate-shaped wall 64 defines a closed bottom on the bucket 40, with the bucket 40 in the receiving orientation, as shown in solid line form in FIGS. 5 and 9, and a closed top on the bucket 40, with the bucket 40 in the discharging orientation, as seen in FIG. 6. Also, the bucket 40 includes a plate 66 of heat insulative material, such as ceramic material, attached on an outer surface of the outboard end wall 60 of the bucket 40. The circular outboard and inboard end walls 60, 62 on the bucket 40 are only slightly smaller in diameter than the inside diameter of the tubular wall 50 of the drum 38. The tight tolerances between the drum 38 and bucket 40 serve to provide a seal between the tubular wall 50 of the drum 38 and the outboard and inboard end walls 60, 62 of the bucket 40 which minimizes the escape of heat from the material processing apparatus 10 and into and from the batched material transferring apparatus 12 and the entrance of air into the pyrolysis chamber 16 which would adversly affect the oxygen based control logic. The presence of the ceramic plate 66 on the outboard end wall 60 of the bucket 40 serves to prevent transmission of heat by conduction to the bucket 40. Also, in order to ensure that the batched materials received into the bucket 40 can readily be discharged therefrom, the inlet opening 46 in the drum 38 is smaller than the side opening in the bucket 40 and, in turn, the side opening in the bucket 40 is smaller than the outlet opening 48 in the drum 40.

Referring to FIGS. 1, 2, 2A and 4, the drive arrangement 42 of the transferring apparatus 12 is mounted adjacent to the exterior of the first, or upstream, end portion 38A of the drum 38 and extends through the upstream end portion 38A of the drum 38 to where it is connected to the inboard end wall 62 of the bucket 40. The drive arrangement 42 is operable to linearly and reciprocally move the bucket 40 along the axial path parallel to the longitudinal axis L between the first and second end portions 38A, 38B of the drum 40 to the respective loading and dumping positions in the interior chamber 44 in which the bucket 40 is respectively aligned with the inlet and outlet openings 46, 48 of the cylindrical drum 38. Also, the drive arrangement 42 is operable to rotatably move the bucket 40 along the rotational or circumferential path around the longitudinal axis L between the receiving and discharging orientations.

More particularly, the drive arrangement 42 includes an elongated track 68, a carriage 70 and an elongated shaft 72. The elongated track 68 includes a pair of laterally spaced track members 74, 76 aligned along opposite sides of the longitudinal axis L of the cylindrical drum 38 and extending away from the upstream end portion 38A of the drum 38. The carriage 70 is slidably mounted by pairs of guide elements 78, 80 to a pair of elongated grooves 82, 84 defined along interior facing sides of the track members 74, 76 to undergo reciprocal movement along the track 68 toward and away from the drum 38 and thus along the longitudinal axis L. The elongated shaft 72 has a pair of first and second spaced ends 72A, 72B. The shaft 72 is connected at the first end 72A to a coupler 86 supported by a pair of braces 88, 90 attached on the inboard end wall 62 of the bucket 40. Also, the shaft 72 is rotatably coupled at the second end 72B to the carriage 70.

The drive arrangement 42 also includes a first drive mechanism 92 and a second drive mechanism 94. The first drive mechanism 92 includes an electric motor 96 mounted on the carriage 70, a drive sprocket 98 attached on a rotary output shaft 100 of the motor 96, a driven sprocket 102 attached on the shaft 72, and a drive chain 104 entrained over the drive and driven sprockets 98, 102 so as to couple in a rotary drive relationship the motor to the shaft 72 between the first and second ends 72A, 72B thereof. The motor 96 is selectively operable to rotate the shaft 72 in the desired direction and thereby cause the desired rotational movement of the bucket 40 between the receiving and discharging orientations of the bucket 40. A limit switch 105, being mounted adjacent to the first drive mechanism 92 and engaged with a cam element 107 mounted on the driven sprocket 102, sets the limits of rotational movement of the shaft 72 about the longitudinal axis L to the desired angular receiving and discharging orientations of the bucket 40.

The second drive mechanism 94 extends between and is connected to the carriage 70 and the end of the track 68 or to an independent support structure (not shown), such as the vessel 14 of the material processing apparatus 10. The second drive mechanism 94 is selectively operable to reciprocally move the carriage 70 and the first drive mechanism 92 and elongated shaft 72 therewith along the track 68 and the longitudinal axis L toward and away from the drum 38. In such manner, the second drive mechanism 94 thereby causes movement of the bucket 40 between the loading and dumping positions. By way of example, the second drive mechanism 94 can be an elongated hydraulic, or air cylinder or a rotary screw.

The batched material transferring apparatus 12 also includes a cover 106 pivotally mounted to a flange 108 encompassing the inlet opening 46 and an actuating mechanism 110 disposed adjacent to the inlet opening 46 of the drum 38. The cover 106 can undergo pivotal movement between a closed position (solid line form in FIG. 3) and an opened position (phantom form in FIG. 3) relative to the inlet opening 46 of the drum 38 to permit introduction of a batch of materials into the drum 38 and bucket 40. The actuating mechanism 110 is connected to the cover 106 and is operable to move the cover 106 between the closed and opened positions. The actuating mechanism 110 includes an elongated arm 112 rigidly attached to the cover 106 and extending in inclined fashion outwardly therefrom and an actuator 114 connected between a support structure 116 and an outer end 112A of the arm 112. The cover 106 is pivotally movable between extended and retracted conditions to correspondingly cause movement of the cover 106 between the closed and opened positions.

To summarize, during operation of the batched materials transferring apparatus 12, the cylindrical bucket 40 is moved in the interior chamber 44 of the cylindrical drum 38 along the axial path relative to the drum 38 between the loading and dumping positions in the interior chamber 44 of the drum 38. In the loading and dumping positions, the bucket 40 is respectively aligned with the inlet and outlet opening 46, 48 of the drum 38. Also during operation of the batched materials transferring apparatus 12, the cylindrical bucket 40 is also moved along the rotational path relative to the drum 38 and in transverse relation to the axial path between the receiving and discharging orientation in the interior chamber 44 of the drum 38. In the loading position and receiving orientation, the bucket 40 is aligned with the inlet opening 46 of the drum 38 for receiving a batch of materials into the bucket 40. In the dumping position and discharging orientation, the bucket 40 is aligned with the outlet opening 48 of the drum 38 for discharging the batch of materials from the bucket 40. The moving of the bucket 40 in the drum 38 along the axial path between the loading and dumping positions can occur either sequentially or concurrently with the moving of the bucket 40 in the drum 38 along the circumferential path between the receiving and discharging orientations.

It is thought that the present invention and many of its attendant advantages will be understood from the foregoing description and it will be apparent that various changes may be made in the form, construction and arrangement of the parts thereof without departing from the spirit and scope of the invention or sacrificing all of its material advantages, the forms hereinbefore described being merely preferred or exemplary embodiments thereof.

I claim:

1. A batched material transferring apparatus, comprising:

(a) an elongated drum having an elongated tubular wall and a pair of end walls attached to respective opposite ends of said tubular wall and defining an elongated interior chamber therein, said drum also having an inlet opening and an outlet opening formed in said tubular wall of said drum adjacent to one another and adjacent to respective ones of said end walls of said drum, said outlet opening being formed through a bottom portion of said tubular wall of said drum, said inlet opening being formed through a portion of said tubular wall of said drum displaced axially and upwardly along said tubular wall of said drum from said bottom portion thereof;

(b) a bucket disposed in said drum and being movable relative to said drum; and (c) means connected to said bucket through one of said end walls of said drum for driving said bucket to undergo movement solely within said interior chamber along a first path relative to said drum between a loading position and a dumping position in said interior chamber in which said bucket is respectively aligned with said inlet opening and said outlet opening in said tubular wall of said drum, said driving means also for driving said bucket to undergo movement solely within said interior chamber along a second path relative to said drum and relative to said first path between a receiving orientation and a discharging orientation such that at said loading position and receiving orientation said bucket is adapted to communicate with said inlet opening in said tubular wall of said drum for receiving a batch of material into said bucket whereas at said dumping position and discharging orientation said bucket is adapted to communicate with said outlet opening in said tubular wall of said drum for discharging the batch of materials from said bucket.

2. The apparatus as recited in claim 1, further comprising:

a cover mounted to undergo movement between closed and opened positions relative to said inlet opening of said drum; and an actuating mechanism disposed adjacent to said drum and connected to said cover, said actuating mechanism being operable to move said cover between said closed and opened positions.

3. The apparatus as recited in claim 2, wherein said actuating mechanism includes:

an arm rigidly attached to said cover and extending outwardly therefrom; and an actuator connected between a support structure and an outer end of said arm and being movable between extended and retracted conditions to correspondingly cause movement of said cover between said closed and opened positions.

4. The apparatus as recited in claim 1, wherein said elongated tubular wall is a substantially cylindrical structure; and said end walls are substantially circular plate-like structures.

5. The apparatus as recited in claim 1, wherein said inlet opening of said drum is formed at a top portion of said tubular wall of said drum.

6. The apparatus as recited in claim 1, wherein said inlet opening of said drum is formed at a side portion of said tubular wall of said drum between a top portion and said bottom portion thereof.

7. The apparatus as recited in claim 1, wherein said bucket has an opening defined therein.

8. The apparatus as recited in claim 7, wherein said opening is defined in a side of said bucket.

9. The apparatus as recited in claim 7, wherein said inlet opening in said drum is smaller than said opening in said bucket.

10. The apparatus as recited in claim 9, wherein said opening in said bucket is smaller than said outlet opening in said drum.

11. The apparatus as recited in claim 1, wherein said bucket includes:

a pair of substantially planar side walls spaced from one another;

a pair of substantially circular plate-like end walls attached respective opposite ends of said spaced side walls so as to define an open top on said bucket with said bucket in said receiving orientation and an open bottom on said bucket with said bucket in said discharging orientation; and a wall attached to and extending between said end walls and side walls so as to defined a closed bottom on said bucket with said bucket in said receiving orientation and a closed top on said bucket with said bucket in said discharging orientation.

12. The apparatus as recited in claim 11, wherein said bucket also includes a plate of heat insulative material attached on an outer surface of one of said end walls of said bucket.

13. The apparatus as recited in claim 1, wherein said driving means includes:

an elongated track aligned along said longitudinal axis of said drum and extending away from said one end wall of said drum; and a carriage mounted on said track to undergo reciprocal movement therealong toward and away from said drum along said longitudinal axis thereof.

14. The apparatus as recited in claim 13, wherein said driving means also includes an elongated shaft having first and second spaced ends, said shaft extending through said one end wall of said drum and being connected at said first end to an end of said bucket and rotatably coupled at said second end to said carriage.

15. The apparatus as recited in claim 14, wherein said driving means further includes a first drive mechanism coupled in a rotary drive relationship to said shaft between said first and second ends thereof and being selectively operable to rotate said shaft and thereby cause movement of said bucket between said receiving orientation and said discharging orientation.

16. The apparatus as recited in claim 15, wherein said driving means still further includes a second drive mechanism extending between and connected to a support structure and said carriage, said second drive mechanism being selectively operable to reciprocally move said carriage and said first drive mechanism and elongated shaft therewith along said track and said longitudinal axis toward and away from said drum and thereby cause movement of said bucket between said loading position and said dumping position.

17. A batched material transferring apparatus, comprising:

(a) an elongated cylindrical drum having an elongated tubular wall and a pair of end walls attached to respective opposite ends of said tubular wall and defining an elongated interior chamber therein, said drum having an inlet opening and an outlet opening formed in said tubular wall of said drum adjacent to one another and adjacent to respective ones of said end walls of said drum, said outlet opening being formed through a bottom portion of said tubular wall of said drum, said inlet opening being formed through a portion of said tubular wall of said drum displaced axially and upwardly along said tubular wall of said drum from said bottom portion thereof;

(b) a bucket disposed in said drum and being movable relative to said drum; and (c) a driving arrangement connected to said bucket through one of said end walls of said drum for driving said bucket to undergo movement solely within said interior chamber along an axial path extending generally along a longitudinal axis and relative to said drum between a loading position and a dumping position in said interior chamber in which said bucket is respectively aligned with said inlet opening and said outlet opening in said tubular wall of said drum, said driving means also for driving said bucket to undergo movement solely within said interior chamber along a circumferential path extending generally around said longitudinal axis and relative to said drum and relative to said first path between a receiving orientation and a discharging orientation such that at said loading position and receiving orientation said bucket is adapted to communicate with said inlet opening in said tubular wall of said drum for receiving a batch of material into said bucket, whereas at said dumping position and discharging orientation said bucket is adapted to communicate with said outlet opening in said tubular wall of said drum for discharging the batch of material from said bucket;

(d) said driving means including (i) an elongated track aligned along said longitudinal axis of said drum and extending away from said one end wall of said drum, (ii) a carriage mounted on said track to undergo reciprocal movement therealong toward and away from said drum along said longitudinal axis thereof, (iii) an elongated shaft having first and second spaced ends, said shaft extending through said one end wall of said drum and being connected at said first end to an end of said bucket and rotatably coupled at said second end to said carriage, (iv) a first drive mechanism coupled in a rotary drive relationship to said shaft between said first and second ends thereof and being selectively operable to rotate said shaft and thereby cause movement of said bucket between said receiving orientation and said discharging orientation, and (v) a second drive mechanism extending between and connected to a support structure and said carriage, said second drive mechanism being selectively operable to reciprocally move said carriage and said first drive mechanism and elongated shaft therewith along said track and said longitudinal axis toward and away from said drum and thereby cause movement of said bucket between said loading position and said dumping position.

18. The apparatus as recited in claim 17, further comprising:

a cover mounted to undergo movement between closed and opened positions relative to said inlet opening of said drum; and an actuating mechanism disposed adjacent to said drum and connected to said cover, said actuating mechanism being operable to move said cover between said closed and opened positions.

19. The apparatus as recited in claim 18, wherein said actuating mechanism includes:

an arm rigidly attached to said cover and extending outwardly therefrom; and an actuator connected between a support structure and an outer end of said arm and being movable between extended and retracted conditions to correspondingly cause movement of said cover between said closed and opened positions.

20. The apparatus as recited in claim 17, wherein said inlet opening of said drum is formed at a top portion of said tubular wall of said drum.

21. The apparatus as recited in claim 17, wherein said inlet opening of said drum is formed at a side portion of said tubular wall of said drum between a top portion and said bottom portion thereof.

22. The apparatus as recited in claim 17, wherein said bucket has an opening defined therein.

23. The apparatus as recited in claim 22, wherein said opening is defined in a side of said bucket.

24. The apparatus as recited in claim 22, wherein said inlet opening in said drum is smaller than said opening in said bucket.

25. The apparatus as recited in claim 22, wherein said opening in said bucket is smaller than said outlet opening in said drum.

26. A batched material transferring method, comprising the steps of:

(a) providing an elongated drum having a longitudinal axis and an elongated tubular wall and a pair of end walls attached to respective opposite ends of the tubular wall and defining an elongated interior chamber therein, the drum also being provided with an inlet opening and an outlet opening formed in the tubular wall of the drum adjacent to one another and adjacent to respective ones of the end walls of the drum, the outlet opening being formed through a bottom portion of the tubular wall of the drum, the inlet opening being formed through a portion of the tubular wall of the drum displaced axially and upwardly along said tubular wall of said drum from said bottom portion thereof;

(b) moving a bucket solely in the interior chamber of the drum along a first path relative to the drum between a loading position and a dumping position in the interior chamber of the drum in which the bucket is respectively aligned with the inlet opening and the outlet opening in the tubular wall of the drum; and (c) moving the bucket solely in the interior chamber of the drum along a second path relative to the drum and relative to the first path between a receiving orientation and a discharging orientation such that at the loading position and receiving orientation the bucket is aligned with the inlet opening in the tubular wall of the drum for receiving a batch of materials into the bucket whereas at the dumping position and discharging orientation the bucket is aligned with the outlet opening in the tubular wall of the drum for discharging the batch of materials from the bucket.

27. The method as recited in claim 26, wherein the first path along which the bucket is moved is an axial path extending generally along the longitudinal axis.

28. The method as recited in claim 26, wherein the second path along which the bucket is moved is a circumferential path extending generally around the longitudinal axis.

29. The method as recited in claim 26, wherein the receiving and discharging orientations of the bucket are angularly displaced approximately 180° from one another.

30. The method as recited in claim 26, wherein the receiving and discharging orientations of the bucket are angularly displaced approximately 85°-90° from one another.

31. The method as recited in claim 26, wherein said moving of the bucket in the drum along the first path relative to the drum between the loading position and dumping position and said moving of the bucket along the second path relative to the drum and to the first path between the receiving orientation and discharging orientation occurs sequentially.

32. The method as recited in claim 26, wherein said moving of the bucket in the drum along the first path relative to the drum between the loading position and dumping position and said moving of the bucket along the second path relative to the drum and to the first path between the receiving orientation and discharging orientation occurs concurrently.

* * * * *